US005502275A

United States Patent [19]

Kondo et al.

[11] Patent Number: 5,502,275

[45] Date of Patent: Mar. 26, 1996

[54] AUTOMATIC ACCOMPANIMENT APPARATUS IMPLEMENTING SMOOTH TRANSITION TO FILL-IN PERFORMANCE

[75] Inventors: Masao Kondo; Shinichi Ito; Hiroki Nakazono, all of Hamamatsu, Japan

[73] Assignee: Yamaha Corporation, Japan

[21] Appl. No.: 228,135

[22] Filed: Apr. 15, 1994

[30] Foreign Application Priority Data

May 31, 1993 [JP] Japan ..... 5-152930

[51] Int. Cl.[6] ..... G10H 1/38; G10H 1/40

[52] U.S. Cl. ..... 84/635; 84/637; 84/667; 84/669; 84/DIG. 12; 84/DIG. 22

[58] Field of Search ..... 84/609–614, 634–638, 84/DIG. 12, DIG. 22, 649–652, 666–669

[56] References Cited

U.S. PATENT DOCUMENTS 4,628,788 12/1986 Shibukawa ..... 84/DIG. 12
4,643,068 2/1987 Okuda et al. ..... 84/DIG. 12
4,646,610 3/1987 Sakurai et al. .
5,208,416 5/1993 Hayakawa et al. .
5,298,677 3/1994 Shimada ..... 84/635

*Primary Examiner*—Stanley J. Witkowski
*Attorney, Agent, or Firm*—Graham & James

[57] ABSTRACT

When a switching operation from a normal pattern to a special pattern is instructed while an automatic accompaniment operation is being executed using normal pattern data, the pattern to be read out is switched from the normal pattern to the special pattern in accordance with the instruction. In this case, when it is instructed to switch the pattern within the instructed bar, only a rhythm part of a plurality of parts is switched from the normal pattern to the special pattern. When it is instructed to switch the pattern at the beginning of the next bar, other parts in addition to the rhythm part are switched from the normal patterns to the special patterns.

17 Claims, 6 Drawing Sheets

EXAMPLE OF NORMAL PATTERN

EXAMPLE OF FILL – IN PATTERN

EXAMPLE OF NORMAL PATTERN

AUTOMATIC ACCOMPANIMENT APPARATUS IMPLEMENTING SMOOTH TRANSITION TO FILL-IN PERFORMANCE

BACKGROUND OF THE INVENTION

1. Field of the Invention

The present invention relates to an automatic accompaniment apparatus and, more particularly, to an automatic accompaniment apparatus which can eliminate unnatural switching to a special pattern such as a fill-in pattern during an automatic accompaniment operation using a normal pattern.

2. Description of the Related Art

Conventionally, in the field of an automatic accompaniment apparatus, a technique for inserting a special pattern such as a fill-in pattern, an ending pattern, or the like during an automatic accompaniment operation using a normal pattern is known. More specifically, when a player turns on an instruction switch such as a fill-in switch, an ending switch, or the like during execution of an automatic accompaniment operation using a normal pattern, the accompaniment pattern is switched to a special pattern.

In this case, whether the accompaniment pattern is switched immediately or from the beginning of the next bar is normally controlled depending on the instructed position, in a bar, of insertion of the fill-in or ending pattern by the player.

For example, the following control is normally performed. That is, in the case of four-four time, when the ON timing of the fill-in switch falls within a range from the beginning of the first beat to the end of the third beat, the accompaniment pattern is immediately switched to the fill-in pattern from that timing; when the ON timing of the fill-in switch falls within a range from the beginning of the fourth beat to the end of the bar, the accompaniment pattern is switched to the fill-in pattern from the beginning of the next bar.

With this control, the player can switch the accompaniment pattern from a desired position.

However, when the accompaniment pattern is switched from a timing in the middle of a bar, the accompaniment pattern changes too suddenly, resulting in an unnatural impression. More specifically, since an accompaniment pattern used so far is temporarily damped, and is then switched to a new accompaniment pattern upon switching of the accompaniment pattern, the flow of music is interrupted at that time, resulting in unnatural insertion.

In particular, tones such as chord backing tones which have a relatively long duration give an unnatural impression if they are damped in the middle of their duration.

SUMMARY OF THE INVENTION

It is an object of the present invention to provide an automatic accompaniment apparatus which can eliminate unnatural switching from a normal pattern to a special pattern such as a fill-in pattern, an ending pattern, or the like.

An automatic accompaniment apparatus according to the present invention comprises storage means for storing normal pattern data consisting of a plurality of parts including a rhythm part, and special pattern data consisting of a plurality of parts including a rhythm part, instructing means for instruction a switching operation from a normal pattern to a special pattern while an automatic accompaniment operation is executed using the normal pattern data, and switching means for switching a pattern to be read out from the normal pattern to the special pattern in accordance with the instruction, the switching means controlling whether the pattern is switched in an instructed bar or the pattern is switched at the beginning of the next bar, switching only the rhythm part of the plurality of parts from the normal pattern to the special pattern when the pattern switching operation is to be performed in the instructed bar, and switching other parts in addition to the rhythm part from the normal patterns to the special patterns when the pattern switching operation is to be performed at the beginning of the next bar.

The special pattern includes, e.g., a fill-in pattern, an ending pattern, or the like. A part for a percussion may be defined as a rhythm part. However, a part for a rhythm producing instrument may also be defined as a rhythm part. For example, a part in which a guitar is played by a cutting method may be defined as a rhythm part. In particular, a rhythm part is preferably determined depending not on the tone color (the type of instrument) but on the content of a pattern. For example, when the accompaniment pattern is switched in the middle of a bar in a part including many sustaining tones, such a switching operation often gives an unnatural impression. Therefore, it is preferable that a part including many sustaining tones not be defined as a rhythm part. Conversely, a part including less sustaining tones can be defined as a rhythm part.

A switching instruction from a normal pattern to a special pattern can control whether pattern switching is performed in a bar including the instruction timing or from the beginning of the next bar. When a pattern switching operation is to be performed within the instructed bar, only a rhythm part of a plurality of parts is switched from a normal pattern to a special pattern. However, when a pattern switching operation is instructed to be performed at the beginning of the next bar, the remaining parts are switched from normal patterns to special patterns in addition to the rhythm part.

DETAILED DESCRIPTION OF THE PREFERRED EMBODIMENTS

A preferred embodiment of the present invention will now be described with reference to the accompanying drawings. In this embodiment, a case will be exemplified wherein an automatic accompaniment operation is performed at four-four time.

Figure 1:
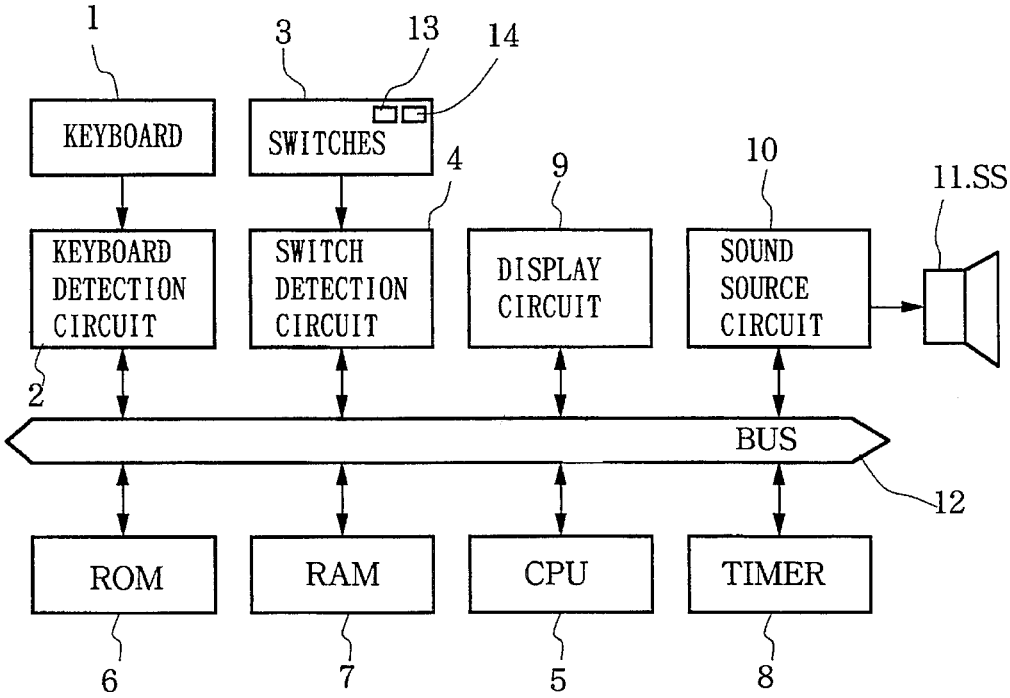
FIG. 1 is a block diagram of an automatic accompaniment apparatus according to an embodiment of the present invention.

FIG. 1 is a block diagram of an automatic accompaniment apparatus according to an embodiment of the present invention. The automatic accompaniment apparatus comprises a keyboard 1, a keyboard detection circuit 2, switches 3, a switch detection circuit 4, a central processing unit (CPU) 5, a read-only memory (ROM) 6, a random-access memory (RAM) 7, a timer 8, a display circuit 9, a sound source circuit 10, and a sound system (SS) 11. Also, the apparatus comprises a bus line 12 for connecting these units.

The keyboard 1 has a plurality of keys to be operated by a user. The keyboard detection circuit 2 detects an operation of the keyboard 1, and outputs performance information such as a key code to the CPU 5.

The switches 3 include various switches arranged on a panel of the automatic accompaniment apparatus. In particular, the switches 3 include a start/stop switch 13 for instructing start/stop of an automatic accompaniment operation, and a fill-in switch 14 for inserting a fill-in pattern during execution of an automatic accompaniment operation using a normal pattern. The switch detection circuit 4 detects an operation of one of the switches 3 by a user, and outputs a detection result to the CPU 5.

The CPU 5 controls the operation of the overall automatic accompaniment apparatus. The ROM 6 stores a program to be executed by the CPU 5, accompaniment pattern data (to be described later with reference to FIG. 3), and the like. The RAM 7 has work areas such as various registers, flags, and the like, which are required upon operation of the CPU 5. The RAM 7 also has an accompaniment pattern area for storing an accompaniment pattern created by the user.

The timer 8 generates a timer interrupt to the CPU at every predetermined interrupt time interval. Every time a timer interrupt is generated, the CPU 5 executes timer interrupt processing (to be described later with reference to FIG. 6).

An interrupt is executed 24 times per quarter note. Since this embodiment assumes four-four time, 96 timer interrupts are generated per bar. In other words, the interrupt time interval is 1/96 of the time interval for one bar. The interrupt time interval can be changed by an operation member (not shown). Thus, the user can desirably set the tempo of an automatic accompaniment operation.

The display circuit 9 is used for displaying various kinds of information in accordance with an instruction from the CPU 5. The sound source circuit generates a tone signal in accordance with an instruction from the CPU 5. The tone signal is input to the sound system 11, and is produced as an actual tone.

An outline of the operation of the automatic accompaniment apparatus of this embodiment will be described below.

Figure 2:
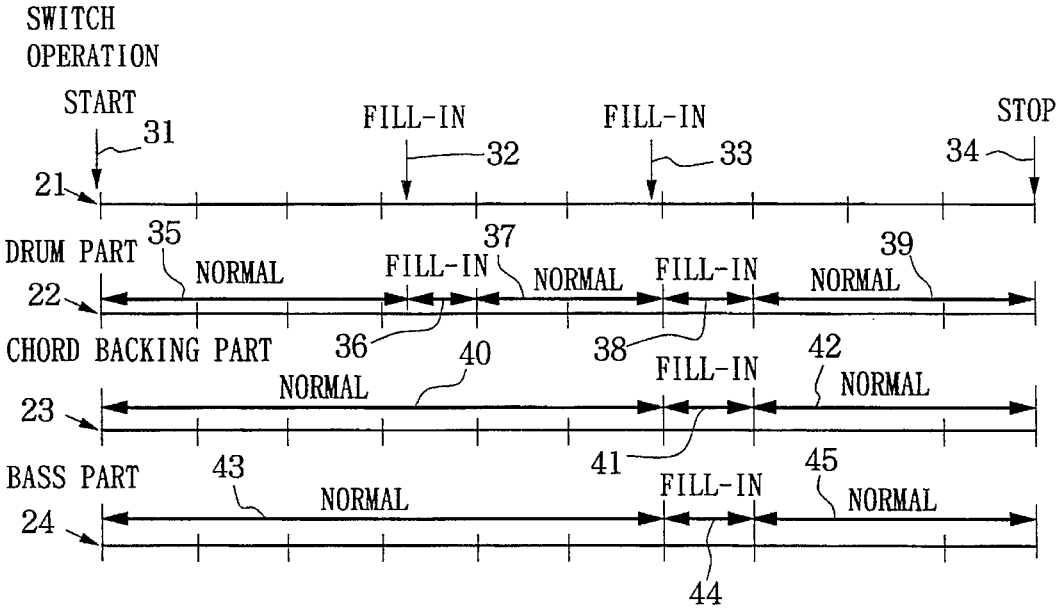
FIG. 2 is an explanatory view for explaining the outline of an operation of the automatic accompaniment apparatus of the embodiment shown in FIG. 1.

FIG. 2 is an explanatory view for explaining the outline of the operation of the automatic accompaniment apparatus of this embodiment. Reference numeral 21 denotes a timing chart of a switch operation by the user. An arrow 31 indicates the ON timing of the start/stop switch 13. From this timing, an automatic accompaniment operation is started. An arrow 34 indicates another ON timing of the start/stop switch 13. With this operation, the automatic accompaniment operation is stopped.

Some dividing lines for dividing a period from the start timing of the arrow 31 to the stop timing of the arrow 34 into equal intervals indicate the divisions of bars. Arrows 32 and 33 indicate the ON timings of the fill-in switch 14. In particular, the arrow 32 indicates the ON timing of the fill-in switch 14 before the timing of the fourth beat (beginning of the fourth beat)+a sixteenth note in a bar, and the arrow 33 indicates the ON timing of the fill-in switch 14 after the timing of the fourth beat+a sixteenth note in a bar.

In the automatic accompaniment apparatus of this embodiment, a method of inserting a fill-in pattern is varied depending on whether the ON timing of the fill-in switch 14 is before or after the timing of the fourth beat+a sixteenth note in a bar.

More specifically, when the fill-in switch 14 is turned on before the timing of the fourth beat+a sixteenth note in a bar, only a rhythm part of an automatic accompaniment pattern is changed from a normal pattern to a fill-in pattern, and the remaining parts are not changed from the normal patterns. When the fill-in switch 14 is turned on after the timing of the fourth beat+a sixteenth note in a bar, all parts including a rhythm part are changed from normal patterns to fill-in patterns from the beginning of the next bar.

Reference numerals 22, 23, and 24 in FIG. 2 denote the operation states of respective parts of an automatic accompaniment pattern when the switch operations are performed as shown in the timing chart 21. When the start/stop switch 13 is turned on at the timing of the arrow 31, a drum part, a chord backing part, and a bass part of an automatic accompaniment pattern start an automatic accompaniment operation. At this time, the patterns of these parts are normal patterns (reference numerals 35, 40, and 43).

When the fill-in switch 14 is turned on at the timing of the arrow 32 before the timing of the fourth beat+a sixteenth note in a bar, only the drum part as a rhythm part of the automatic accompaniment parts is switched from a normal pattern to a fill-in pattern (reference numeral 36). At this time, the patterns of the chord backing part and the bass part are not changed from normal patterns. After the fill-in pattern is inserted, the pattern of the drum part is returned to a normal pattern (reference numeral 37).

When the fill-in switch 14 is turned on at the timing of the arrow 33 after the timing of the fourth beat+a sixteenth note in a bar, fill-in patterns are inserted from the beginning of the next bar (reference numerals 38, 41, and 44). After insertion of the fill-in pattern, the patterns of the switched parts are returned to normal patterns (reference numerals 39, 42, 20 and 45).

The reason why the ON timing of the fill-in switch 14 is discriminated based not on the beginning of the fourth beat in a bar but on the position of the fourth beat+a sixteenth note is as follows.

Basically, when the ON timing of the fill-in switch is before the fourth beat, the accompaniment pattern is immediately switched to a fill-in pattern, and when the ON timing of the fill-in switch is after the fourth beat, the accompaniment pattern is immediately switched to a fill-in pattern from the beginning of the next bar. However, when a user wants to insert a fill-in pattern from the fourth beat, and depresses the fill-in switch, if his or her depression timing is slightly delayed, the fill-in pattern is inserted from the next bar. In order to avoid such an inconvenience, in this embodiment, a delay for a sixteenth note is allowed.

Data such as registers, flags, and the like in the automatic accompaniment apparatus of this embodiment will be described below.

(A) RUN: a run flag indicating whether or not an automatic accompaniment operation is in execution. When the run flag is "1", it indicates that an automatic accompaniment operation is in execution; when the run flag is "0", it indicates that an automatic accompaniment operation is not in execution.

(B) BEAT: a register for storing current timing data indicating the current timing in a bar. Since this embodiment assumes four-four time, the current timing beat assumes a value ranging from 0 to 95. Every time a timer interrupt is generated, the content of the current timing register BEAT is incremented, and is returned to 0 after 95.

(C) FILL: a fill-in flag. This flag normally assumes "0", and when the flag is set to be "1", it indicates that a fill-in pattern is to be inserted from the beginning of the next bar.

(D) DTIME: a timing register for storing timing data in pattern data (to be described later with reference to FIG. 3) of the drum part. After timing data of the drum part read out from pattern data is set in the register, the content of the register is decremented by one every time a timer interrupt is generated. When the content of the register reaches 0, the next event data in the pattern data is read out and executed.

(E) CTIME: a timing register for storing timing data in pattern data of the chord backing part. This register is used in the same manner as the register DTIME.

(F) BTIME: a timing register for storing timing data in pattern data of the bass part. This register is used in the same manner as the register DTIME.

(G) END: an end flag which is set to be "1" when the end of pattern data is read out.

Figure 3:
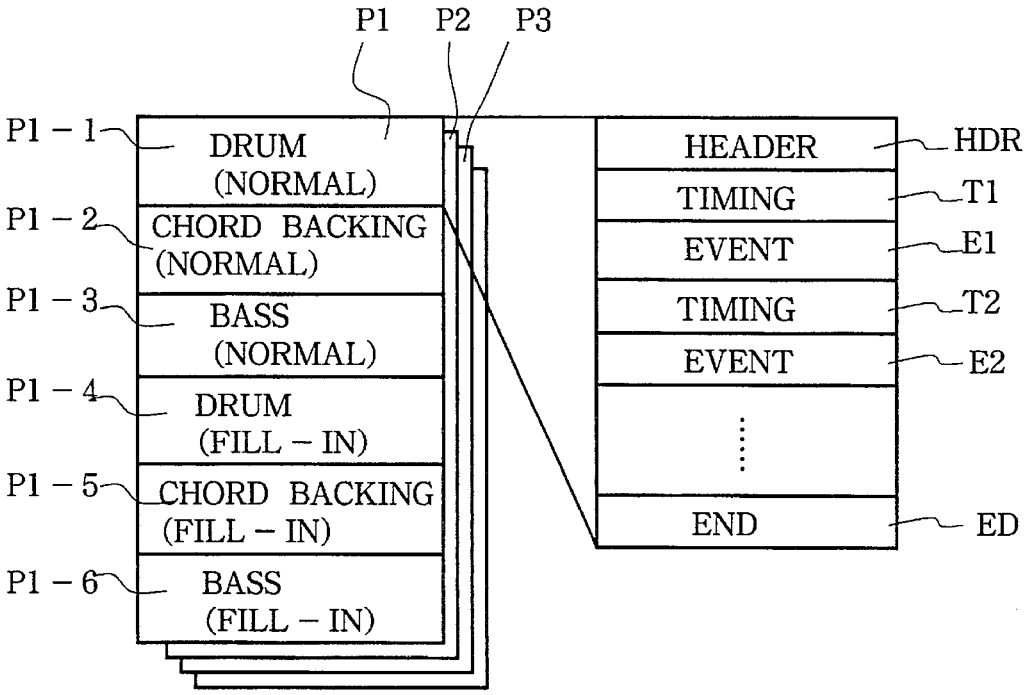
FIG. 3 is a view showing the format of pattern data.

(H) Pattern data: pattern data for an automatic accompaniment operation. FIG. 3 shows the format of pattern data. Pattern data P1, P2, . . . are provided in correspondence with styles such as rock, disco, and the like.

Referring to FIG. 3, one pattern data, e.g., pattern data P1, comprises normal patterns of a drum part Pi-1, a chord backing part P1-2, and a bass part P1-3, and fill-in patterns of a drum part P1-4, a chord backing part P1-5, and a bass part P1-6. The pattern data is provided for a predetermined number of bars (e.g., a normal pattern for two bars, a fill-in pattern for one bar, and the like), and is repetitively read out to perform an automatic accompaniment operation.

A header HDR is allocated at the beginning of pattern data of each part. The header HDR stores tone color information for the corresponding part (in the case of the drum part, information associated with a drum set, and the like), and various other kinds of setting information.

Following the header HDR, timing data T1, T2, . . . , event data E1, E2, . . . are stored. The timing data indicates an event generation timing (event interval). The event data indicates various kinds of information associated with a note event. For example, event data includes a tone generation instruction event, a tone color change event, and the like.

The above-mentioned symbols herein denote not only the registers, flags, and the like but also the values (setting data) of these registers, flags, and the like. For example, RUN indicates not only the run flag itself but also the value of the run flag.

The operation of the automatic accompaniment apparatus of this embodiment will be described in detail below.

Figure 4:
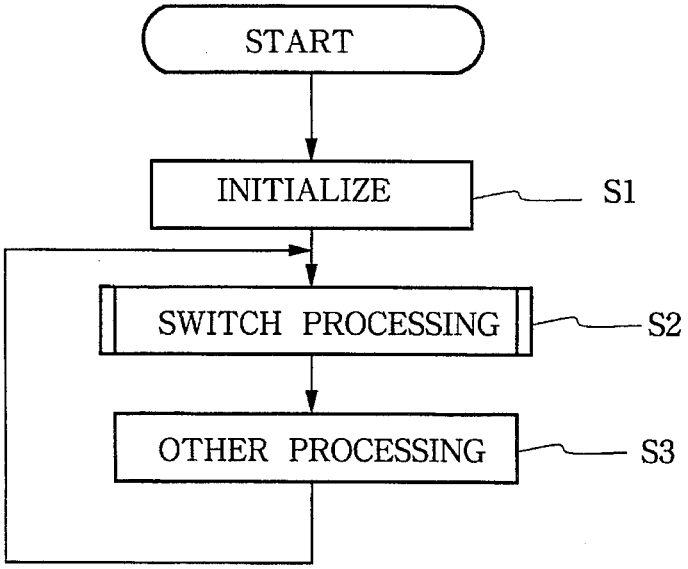
FIG. 4 is a flow chart showing a main routine of the automatic accompaniment apparatus of the embodiment shown in FIG. 1.

FIG. 4 shows the main routine of the automatic accompaniment apparatus of this embodiment. In this automatic accompaniment apparatus, when a power switch is turned on, the registers, flags, and the like are initialized in step S1. In particular, the run flag RUN, the current timing register BEAT, the fill-in flag FILL, and the end flag END are initialized to "0". Switch processing is executed in step S2, and other processing is executed in step S3. Thereafter, the flow returns to step S2.

Figure 5:
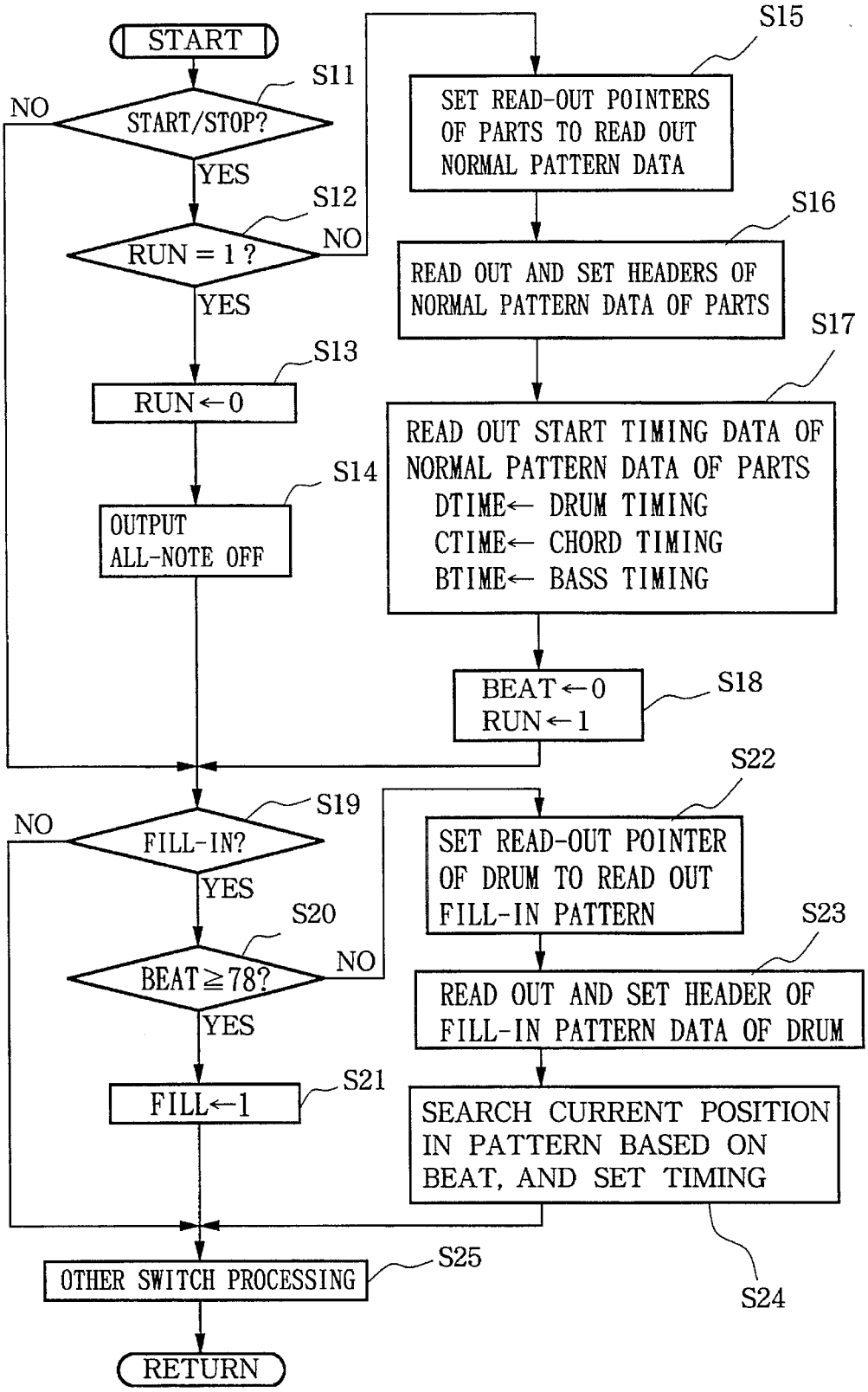
FIG. 5 is a flow chart showing a switch processing routine.

FIG. 5 is the detailed flow chart of the switch processing routine in step S2 in FIG. 4. In the switch processing routine, it is checked in step S11 if an ON event of the start/stop switch 13 is detected. If YES in step S11, the flow advances to step S12; otherwise, the flow advances to step S19.

In step S12, it is checked if the run flag RUN is "1". If YES in step S12, "0" is set in the run flag RUN in step S13 to stop an automatic accompaniment operation in execution, and an all-note OFF signal is output to the sound source circuit 10 in step S14. Thereafter, the flow advances to step S19.

If it is determined in step S12 that the run flag RUN is not "1", the start addresses of normal patterns are set in corresponding read-out pointers of the respective parts in step S15 so as to start an automatic accompaniment operation. For example, when the pattern data P1 in FIG. 3 is designated, the start address of the normal pattern P1-1 of the drum part is set in the read-out pointer of the drum part, the start address of the normal pattern P1-2 of the chord backing part is set in the read-out pointer of the chord backing part, and the start address of the normal pattern P1-3 of the bass part is set in the read-out pointer of the bass part.

In step S16, the headers HDR of normal patterns of the respective parts are read out, and tone color information (in the case of the drum part, information associated with a drum set, and the like) and various other kinds of setting information set in the readout headers HDR are set in the sound source circuit 10. In step S17, the start timing data (T1 in FIG. 3) of normal patterns of the respective parts are read out. Thereafter, the timing data of the drum part is set in the register DTIME, the timing data of the chord backing pattern is set in the register CTIME, and the timing data of the bass part is set in the register BTIME.

In step S18, the current timing register BEAT is initialized to "0", and "1" is set in the run flag RUN, thus indicating that an automatic accompaniment operation is in execution. Thereafter, the flow advances to step S19.

In step S19, it is checked if an ON event of the fill-in switch 14 is detected. If YES in step S19, the flow advances to step S20; otherwise, the flow advances to step S25.

In step S20, it is checked if the content of the current timing register BEAT is "78" or more. In this checking step, the current timing is compared with the timing of the fourth beat+a sixteenth note in a bar. If the current timing is after the timing of the fourth beat+a sixteenth note (BEAT $\geqq$78), "1" is set in the fill-in flag in step S21 to insert a fill-in pattern from the next bar. Thereafter, the flow advances to step S25 to execute other switch processing, and the flow then returns to the main routine.

If it is determined in step S20 that the current timing is before the timing of the fourth beat+a sixteenth note (BEAT <78), the flow advances to step S22 to immediately insert a fill-in pattern.

In step S22, the read-out pointer of the drum part is set to insert a fill-in pattern. For example, when a fill-in pattern is inserted in the pattern data P1 in FIG. 3, the start address of the fill-in pattern P1-4 of the drum part is set in the read-out pointer of the drum part. The remaining parts are not changed from normal patterns.

In step S23, the header HDR of the fill-in pattern of the drum part is read out, and information associated with a drum set and other kinds of setting information set in the readout header HDR are set in the sound source circuit 10. In step S24, the current position in the fill-in pattern of the drum part is detected on the basis of the content of the current timing register BEAT, and the calculated timing data is set in the register DTIME. Thereafter, the flow advances to step S25.

Figure 6:
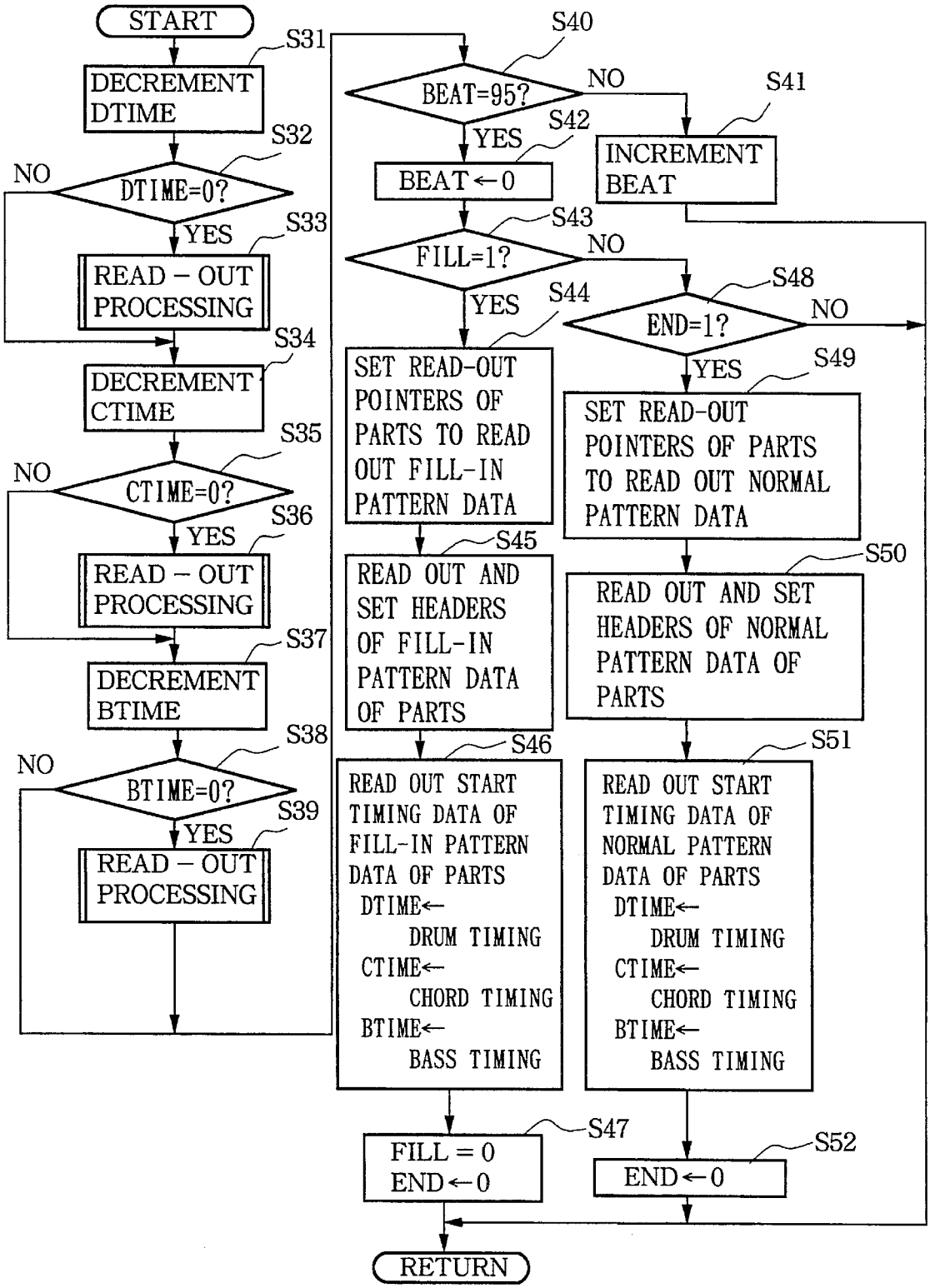
FIG. 6 is a flow chart showing a timer interrupt routine.

The timer interrupt routine will be described below with reference to the flow chart in FIG. 6. As described above, a timer interrupt is generated at each of the timings obtained by equally dividing a bar by 96, and the processing shown in FIG. 6 is executed.

In the timer interrupt routine, the timing DTIME of the drum part is decremented in step S31. It is checked in step S32 if the timing DTIME of the drum part reaches "0". If YES in step S32, since it indicates that there is event data to be executed, read-out processing is executed in step S33. The read-out processing will be described later with reference to FIG. 7. After step S33, or if NO in step S32, the flow advances to step S34.

In step S34, the timing CTIME of the chord backing part is decremented. It is then checked in step S35 if the timing CTIME of the chord backing part reaches "0". If YES in step S35, since it indicates that there is event data to be executed, the read-out processing is executed in step S36. After step S36 or if NO in step S35, the flow advances to step S37.

In step S37, the timing BTIME of the bass part is decremented. It is then checked in step S38 if the timing BTIME of the bass part reaches "0". If YES in step S38, since it indicates that there is event data to be executed, the read-out processing is executed in step S39. After step S39 or if NO in step S38, the flow advances to step S40.

In step S40, it is checked if the current timing BEAT reaches "95". If YES in step S40, since it indicates the end of a bar, the flow advances to step S42; otherwise, the current timing BEAT is incremented in step S41, and the flow returns to the main routine.

In step S42, the current timing BEAT is reset to "0" as a value indicating the beginning of a bar. In step S43, it is checked if the fill-in flag FILL is "1". If YES in step S43, the read-out pointers of the respective parts are set to insert fill-in patterns from this timing (the beginning of a bar) in step S44.

For example, in the case of the pattern data P1 in FIG. 3, the start address of the fill-in pattern P1-4 of the drum part is set in the read-out pointer of the drum part, the start address of the fill-in pattern P1-5 of the chord backing part is set in the read-out pointer of the chord backing part, and the start address of the fill-in pattern P1-6 of the bass part is set in the read-out pointer of the bass part.

In step S45, the headers HDR of the fill-in patterns of the respective parts are read out, and various kinds of setting information such as tone color information set in the readout headers HDR are set in the sound source circuit 10. In step S46, the start timing data of the fill-in patterns of the respective parts are read out. Then, the timing data of the drum part is set in the register DTIME, the timing data of the chord backing part is set in the register CTIME, and the timing data of the bass part is set in the register BTIME.

In step S47, the fill-in flag FILL and the end flag END are reset to "0", and the flow returns to the main routine.

If it is determined in step S43 that the fill-in flag FILL is not "1", it is checked in step S48 if the end flag END is "1". If YES in step S48, since it indicates the end of pattern data, the flow advances to step S49 to read out the normal patterns from the beginning again. The processing operations in steps S49, S50, and S51 are the same as those in steps S15, S16, and S17 executed when an automatic accompaniment operation is started. More specifically, the start addresses of the normal patterns are set in the read-out pointers of the respective parts, the headers are read out to set information, and the start timing data are read out and set in the corresponding timing registers.

After step S51, the end flag END is set to be "0" in step S52, and the flow returns to the main routine. If it is determined in step S48 that the end flag END is not "1", the flow returns to the main routine.

The read-out processing routine will be described below with reference to the flow chart in FIG. 7. The read-out processing routine is executed in steps S33, S36, and S39 in FIG. 6 in correspondence with parts.

Figure 7:
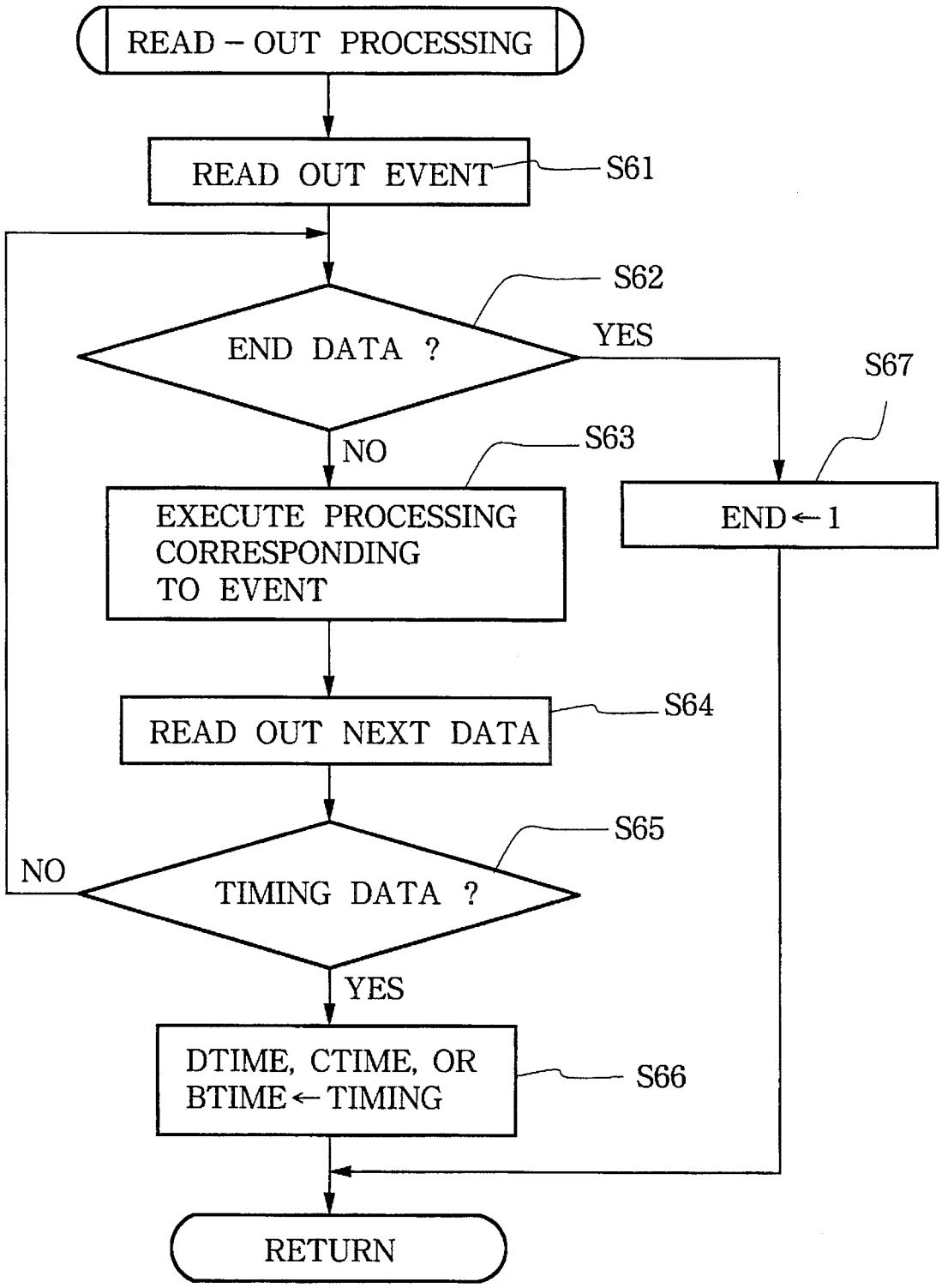
FIG. 7 is a flow chart showing a read-out processing routine.

Referring to FIG. 7, in step S61, event data next to timing data (which was set in the corresponding register, was decremented, and has reached "0") indicated by the read-out pointer of the corresponding part is read out. In step S62, it is checked if the readout event data is end data ED (FIG. 3). If YES in step S62, "1" is set in the end flag END in step S67 to indicate that the accompaniment pattern must be returned to the beginning of a normal pattern at the timing corresponding to the beginning of the next bar.

If it is determined in step S62 that the readout event data is not end data, processing corresponding to the readout event data is executed in step S63. For example, if the readout event data is one for instructing tone generation, tone generation is executed; if the readout event data is one for instructing to change the tone color, the tone color is changed. In step S64, the read-out pointer is advanced to data next to the currently readout event data, and the data indicated by the pointer is read out.

In step S65, it is checked if the readout data is timing data. If NO in step S65, the flow returns to step S62 to execute processing for the readout data in step S62 and subsequent steps. However, if YES in step S65, the readout timing data is set in the timing register of the currently processed part, i.e., one of the registers DTIME, CTIME, and BTIME, and the flow then returns to the previous routine.

In this embodiment, the drum part is defined as a rhythm part, and when a fill-in pattern is inserted from the middle of a bar, the pattern of only the drum part is switched to the fill-in pattern. However, the present invention is not limited to the drum part. For example, parts of a bass or other instruments may be defined as rhythm parts. A rhythm part may be determined on the basis of the tone color of the corresponding part. However, it is preferable that a rhythm part be determined based on the content of the corresponding pattern.

For example, a part which includes many sustaining tones and gives an unnatural impression if it is switched to a fill-in pattern in the middle of a bar is not determined to be a rhythm part, and a part which includes less sustaining tones and does not give an unnatural impression even if it is switched in the middle of a bar is determined to be a rhythm part.

Figure 8:
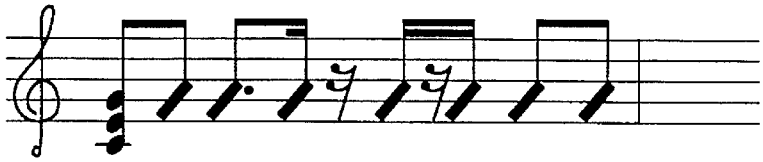
FIGS. 8(*a*) to 8(*c*) are views showing examples of guitar cutting patterns.
Figure 8:
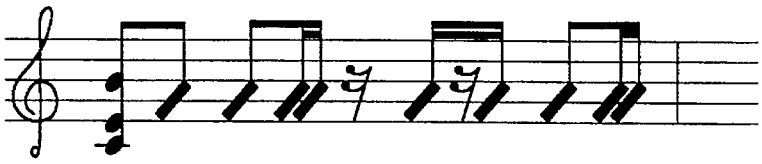
Figure 8:
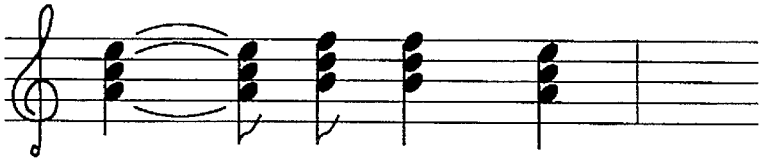

FIGS. 8(*a*) and 8(*b*) show examples of guitar cutting patterns, which respectively correspond to normal and fill-in patterns. A pattern shown in FIG. 8(*a*) does not give an unnatural impression even if it is switched from a normal pattern in FIG. 8(*a*) to a fill-in pattern in FIG. 8(*b*) in the middle of a bar, since a guitar is used as a rhythm instrument, and the pattern does not include any tones which have a relatively long duration. Therefore, the pattern shown in FIG. 8(*a*) can be defined as a rhythm part as in the drum part of the above embodiment.

FIG. 8(*c*) also shows an example of a guitar accompaniment pattern. Although this pattern is also played by a guitar, the pattern in FIG. 8(*c*) includes sustaining tones, and gives an unnatural impression if it is switched to a fill-in pattern in the middle of a bar. Therefore, it is preferable that such a pattern not be used as a rhythm part. Also, an accompaniment pattern of guitar arpeggio tones gives an unnatural impression if the tones are interrupted halfway through. For this reason, it is preferable that such a pattern not be used as a rhythm pattern.

In the above embodiment, a fill-in pattern is inserted in the middle of a normal pattern. However, the present invention is not limited to this. For example, the present invention can be applied to a case wherein an arbitrary normal pattern is switched to an arbitrary special pattern. For example, the present invention may be applied to a case wherein a normal pattern is switched to an ending pattern.

In the above embodiment, the accompaniment pattern is immediately switched to a fill-in pattern when the ON timing of the fill-in switch (a switching instruction to a special pattern) is before the timing of the fourth beat+a sixteenth note in a bar. The present invention is not limited to the timing of the fourth beat+a sixteenth note, but another timing may be used. When a switching instruction to a special pattern, e.g., an ON event of the fill-in switch, is issued, the pattern may be switched not immediately but at the next beat timing.

Furthermore, two operation members such as the fill-in switch for instructing a pattern switching operation may be arranged, so that one operation member may be used for instructing pattern switching in the current bar, and the other operation member may be used for instructing pattern switching at the beginning of the next bar.

In the above embodiment, a player issues a pattern switching instruction using an operation member. However, a switching instruction method is not limited to this. For example, automatic accompaniment data stored in a pattern sequencer may include fill-in instruction data, and a fill-in switching operation may be instructed by this data. In this case, when fill-in instruction data is read out, the same processing as that executed when the fill-in switch is turned on in the above-mentioned embodiment may be performed. Also, pattern switching may be performed on the basis of touch information of the keyboard.

Furthermore, in the above embodiment, the accompaniment pattern is returned to the beginning of a normal pattern after a fill-in pattern is inserted. For example, when a normal pattern is one for four bars, and a fill-in pattern is inserted in the second bar of the normal pattern, the accompaniment pattern may be returned not to the beginning of the normal pattern but to the middle (e.g., the third bar) of the original normal pattern. For this purpose, a read-out pointer for a normal pattern and a read-out pointer for a fill-in pattern are provided, and are advanced according to the current timing, so that one of these patterns is properly used in an automatic accompaniment operation. Also, when only a rhythm pattern is switched from a normal pattern to a fill-in pattern, the accompaniment pattern may be returned to the middle of the normal pattern after the end of the fill-in pattern; when all parts are switched from normal patterns to fill-in patterns, the accompaniment pattern may be returned to the beginning of the normal patterns after the end of the fill-in patterns.

In the above embodiment, when a normal pattern is switched to a fill-in pattern from the beginning of a bar, the patterns of all parts are switched. In this case, the pattern of at least one non-rhythm part may be switched in addition to the rhythm part. For example, a pattern which remains the same all the time may be included.

As described above, according to the present invention, when the accompaniment pattern is switched in the middle of a bar, the pattern of only a rhythm part is switched. For this reason, the switching operation of the pattern in the middle of a bar does not give an unnatural impression. When the accompaniment pattern is switched from the beginning of the next bar, the patterns of other parts are switched in addition to the rhythm part. Therefore, the image of music can be dynamically changed, and since a pattern switching operation is performed at the division of a bar, no unnatural impression of music is given.

What is claimed is:

1. An automatic accompaniment apparatus comprising:

storage means for storing normal pattern data comprising a plurality of normal pattern parts including a normal pattern rhythm part, and for storing special pattern data comprising a plurality of special pattern parts including a special pattern rhythm part;

instruction means for instructing a switching operation from a normal pattern to a special pattern while an automatic accompaniment operation is executed using the normal pattern data; and switching means for switching a pattern to be read out from the normal pattern to the special pattern in accordance with said instruction, said switching means controlling whether the pattern is switched in an instructed bar or the pattern is switched at the beginning of the next bar, switching only the normal pattern rhythm part to the special pattern rhythm part when the pattern switching operation is to be performed in the instructed bar, and switching at least one other normal pattern part in addition to the normal pattern rhythm part to a special pattern part when the pattern switching operation is to be performed at the beginning of the next bar.

2. An apparatus according to claim 1, wherein said switching means controls whether the pattern is switched in the bar or at the beginning of the next bar depending on whether the switching instruction timing of said instruction means is before or after a predetermined timing in a bar.

3. An apparatus according to claim 1, wherein said rhythm part is a drum performance part.

4. An apparatus according to claim 1, wherein said special pattern is a fill-in pattern.

5. An automatic accompaniment apparatus comprising:

storage means for storing pattern data comprising a plurality of parts including a rhythm part;

automatic accompaniment means for performing an automatic accompaniment according to plural parts of the pattern data stored in said storage means;

instruction means for instructing a switching operation from the current pattern to another pattern while an automatic accompaniment operation is executed using said automatic accompaniment means; and switching means for switching the current pattern to be automatically performed to another pattern in accordance with the instruction, said switching means switching only the rhythm part of said plurality of parts to another pattern if the instruction is received by said switching means before a predetermined timing in a bar of the current pattern, and switching the rhythm part and at least one additional part if the instruction is received by said switching means from said predetermined time until an end of said bar.

6. An apparatus according to claim 5, wherein said rhythm part is a drum performance part.

7. An apparatus according to claim 5, wherein said another pattern is a fill-in pattern.

8. An apparatus according to claim 5, wherein when only said rhythm part is switched the switching occurs in the bar in which said instruction is received, and when said rhythm part and said at least one additional part are switched the switching occurs at the beginning of the bar following the bar in which said instruction is received.

9. An automatic accompaniment apparatus comprising:

automatic accompaniment means for selectively performing a plurality of predetermined musical patterns including a first rhythm pattern, a second rhythm pattern, a first other pattern, and a second other pattern;

a selector for instructing a change of automatic accompaniment from one group of predetermined musical patterns to another group; and a controller responsive to said selector and coupled to said accompaniment means, separately controlling switching of said first rhythm pattern to said second rhythm pattern and switching of said first other pattern to said second other pattern depending on a timing of the selecting of the musical patterns relative to a bar of said musical patterns being currently performed.

10. An apparatus according to claim 9, wherein said second patterns are fill-in patterns.

11. An apparatus according to claim 9, wherein said second patterns are end patterns.

12. An apparatus according to claim 9, wherein said controller switches only said first rhythm pattern to said second rhythm pattern if said selecting occurs before a predetermined timing in the current bar of the musical patterns being performed by said accompaniment means.

13. An apparatus according to claim 9, wherein said controller switches said first rhythm pattern to said second rhythm pattern and said first other pattern to said second other pattern at the beginning of the bar following the bar in which said selecting occurs if said selecting does not occur before a predetermined timing in the current bar of the musical patterns being performed by said accompaniment means.

14. An apparatus according to claim 9, wherein said first other pattern comprises a first chord pattern and said second other pattern comprises a second chord pattern.

15. An apparatus according to claim 9, wherein said first other pattern comprises a first bass pattern and said second other pattern comprises a second bass pattern.

16. In a musical tone generation system comprising an apparatus for generating tones according to automatic accompaniment patterns, a method of changing automatic accompaniment patterns comprising the steps of:

generating tones according to a first rhythm pattern and a first other pattern using said automatic accompaniment apparatus;

detecting an instruction for changing the automatic accompaniment; and switching from the first rhythm pattern to said second rhythm pattern while maintaining the first other pattern when said instruction is detected before a predetermined timing in a current bar of the first patterns and switching from the first rhythm pattern to said second rhythm pattern and from said first other pattern to said second other pattern at the beginning of the bar following detection of said instruction if said instruction is not detected before said predetermined timing.

17. A method of changing automatic accompaniment patterns according to claim 16 wherein said first other pattern comprises at least one of a first chord pattern and a first bass pattern and said second other pattern comprises at least one of a second chord pattern and a second bass pattern.

* * * * *